US012484716B1

(12) United States Patent
Bradshaw

(10) Patent No.: US 12,484,716 B1
(45) Date of Patent: Dec. 2, 2025

(54) FOLDING ANGLE SHELF SUPPORT DISPLAY APPARATUS

(71) Applicant: Lucas W Bradshaw, Bentonville, AR (US)

(72) Inventor: Lucas W Bradshaw, Bentonville, AR (US)

( * ) Notice: Subject to any disclaimer, the term of this patent is extended or adjusted under 35 U.S.C. 154(b) by 0 days.

(21) Appl. No.: 18/398,830

(22) Filed: Dec. 28, 2023

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC .. A47F 5/116; A47F 5/11; A47F 5/112; A47B 43/02; A47B 55/06; A47B 47/06
USPC ..... 211/71.01, 72, 135
See application file for complete search history.

(56) References Cited

U.S. PATENT DOCUMENTS 1,204,920 A 11/1916 Williamson
2,150,743 A * 3/1939 Mancuso ..... G09F 5/00 229/108.1
2,277,807 A * 3/1942 Whitestone ..... A47F 5/116 108/99
3,860,305 A * 1/1975 Bergman ..... B65D 5/48046 229/162.1
3,987,737 A * 10/1976 Smith ..... A47F 5/116 108/179
4,506,790 A * 3/1985 Muscari ..... A47F 5/116 211/59.4
4,709,642 A * 12/1987 Briosi ..... A47B 47/025 108/187
4,880,327 A 11/1989 Sanabria
5,443,168 A * 8/1995 Dyment ..... A47F 5/116 211/186
5,702,011 A * 12/1997 Carroll ..... A47F 5/04 211/186
5,706,959 A * 1/1998 Smith ..... A47F 5/0018 108/165
6,098,820 A * 8/2000 Smith ..... A47F 5/116 211/132.1
6,135,033 A * 10/2000 Deferrari ..... A47F 5/116 108/165
6,394,290 B1 5/2002 Walsh et al.
6,929,133 B1 * 8/2005 Knapp, III ..... A47F 5/0807 211/132.1
7,546,927 B2 * 6/2009 Lowry ..... A47F 3/142 206/557
7,810,707 B2 * 10/2010 Little ..... B65D 5/0075 229/199
8,601,956 B2 12/2013 Ceballos-Godefroy
9,844,282 B2 * 12/2017 Smith ..... A47B 43/02
9,949,579 B1 * 4/2018 Frost ..... A47F 5/116
10,966,519 B2 * 4/2021 Ng ..... A47B 43/00
11,089,886 B2 * 8/2021 Diaz ..... A47F 5/118
(Continued)

*Primary Examiner* — Jennifer E. Novosad
(74) *Attorney, Agent, or Firm* — Keisling & Pieper PLC; Trent C. Keisling; David B. Pieper

(57) ABSTRACT

A folding-angle-shelf-support display with shelfs supported by an inward folding shelf support constructed as two hinged arms extending and folding inward from outward folding sides. The display uses a front panel constructed as beams and apertures connected to outward folding side plates and a panel style back for rigidity. The shelves are connected to the front beams and the back panel, and inward folding supports extend inward from the outward folding side plates.

3 Claims, 21 Drawing Sheets

(56) References Cited

U.S. PATENT DOCUMENTS

| | | | | |
|---|---|---|---|---|
| 11,540,652 | B1 * | 1/2023 | Summerfield | A47F 5/114 |
| 2004/0148825 | A1 * | 8/2004 | Myers | A47F 5/116<br>40/124 |
| 2014/0014606 | A1 * | 1/2014 | Mestres Armengol | A47F 5/11<br>211/135 |
| 2015/0136720 | A1 * | 5/2015 | Miller | A47F 5/101<br>29/466 |
| 2016/0066711 | A1 * | 3/2016 | Mestres Armengol | A47F 5/112<br>211/195 |
| 2019/0014927 | A1 * | 1/2019 | Nixon | A47B 55/06 |
| 2020/0375375 | A1 * | 12/2020 | Robinson | A47B 55/06 |
| 2023/0397721 | A1 * | 12/2023 | Doane | A47F 5/114 |

* cited by examiner

FOLDING ANGLE SHELF SUPPORT DISPLAY APPARATUS

CROSS-REFERENCE TO RELATED APPLICATIONS

Not Applicable.

FEDERALLY SPONSORED RESEARCH AND DEVELOPMENT

Not Applicable.

JOINT RESEARCH AGREEMENT

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

PRIOR ART

Patents disclosing information relevant to displays include: U.S. Pat. No. 1,204,920, issued to Williamson on Nov. 14, 1916 entitled Folding Display Easel; U.S. Pat. No. 4,880,327, issued to Sanabria on Nov. 14, 1989 entitled Gravity lock bookstand and binder; U.S. Pat. No. 6,394,290, issued to Walsh et al. on May 28, 2002 entitled display stand; and U.S. Pat. No. 8,601,956, issued to Ceballos-Godefroy on Dec. 10, 2013 entitled Folding display and work furniture item. Each of these patents is hereby expressly incorporated by reference in their entirety.

From these prior references it may be seen that these prior art patents are very limited in their teaching and utilization, and an improved Folding Angle Shelf Support Display Apparatus is needed to overcome these limitations.

BACKGROUND OF THE INVENTION

The present invention relates to improvements in flat shipping displays that allow for a flattened display to ship with products. More particularly, the invention relates to improvements particularly suited for providing shelf support for heavier items using a support that unfolds during set up of the product display. In particular, the present invention relates specifically to an inwardly folding hinged arm that locks into position as a shelf support. As will be appreciated by those skilled in the art, basic folding displays are known in various forms.

SUMMARY OF THE INVENTION

The present invention is directed to a folding display with a unique shelf support. A folding-angle-shelf-support display is provided with a front having cross beams and defining access apertures opposite from a structural panel back, with the front and back connected by outward folding sides. Folding shelves are then provided between the front and back. The shelfs are supported off of the front and back and are mid supported by an inward folding shelf support extending inward from the outward folding sides.

Additional details include the front beams including reinforcing head tabs, the outward folding side plate including an inward folding reinforcement flap that folds at an angle in relation to the fold crease. Further details include a side locking aperture in the back panel that captures a flap locking tab on the inward folding reinforcement flap, shelf locking apertures on the back panel that capture shelf locking tabs, and support locking apertures on the shelves that secure support locking tabs on the inward folding shelf support. Inward feet, stiffener plates, opposing shelf supports, inward folding extending bodies with triangular bodies using support locking tabs, front extending arms connected to an inner arm hinge that are then connected to a back extending arm all using a locking angle with a locking edge are also provided.

DETAILED DESCRIPTION OF THE INVENTION

Figure 1:
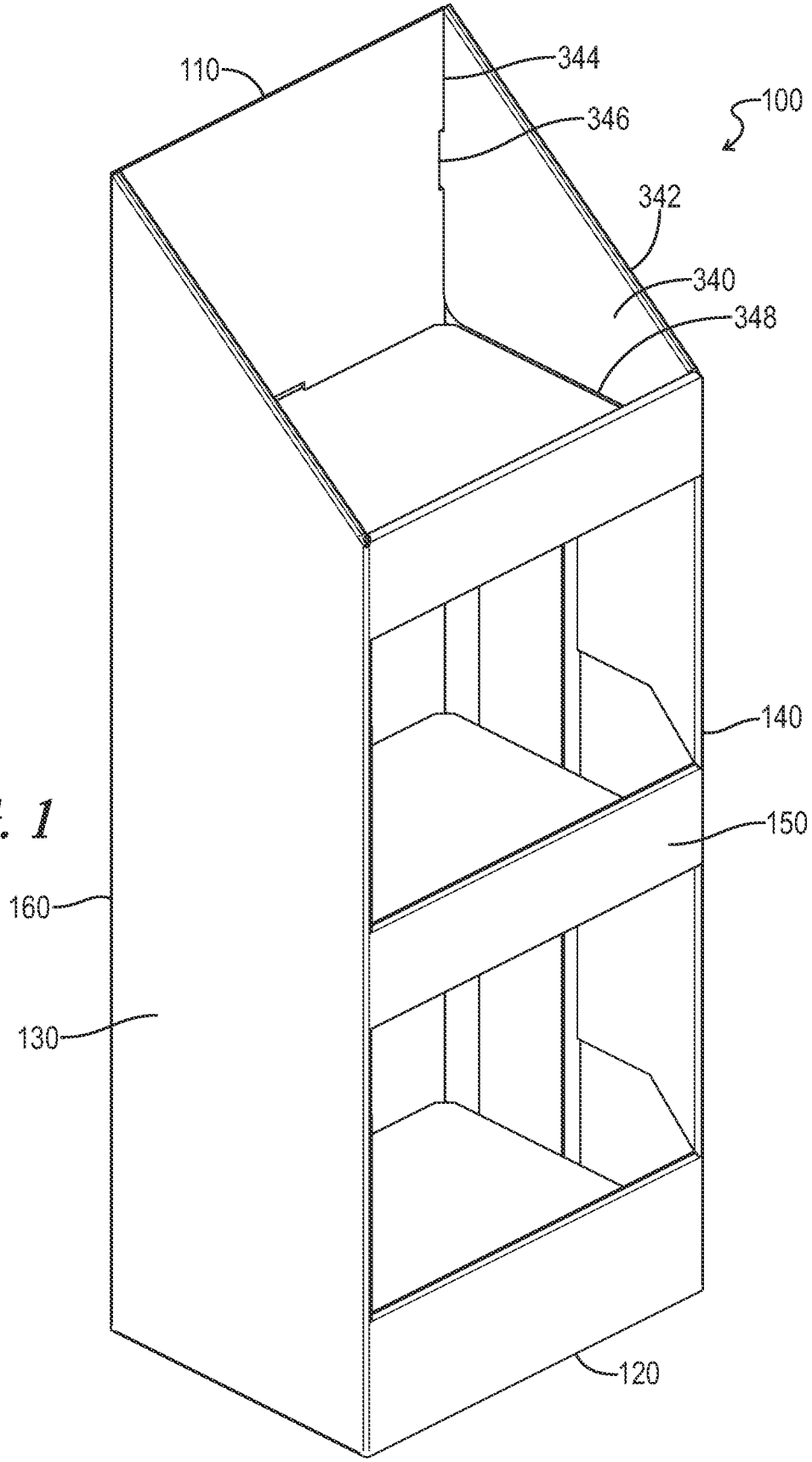
FIG. 1 shows a perspective view of a Folding Angle Shelf Support Display Apparatus.
Figure 2:
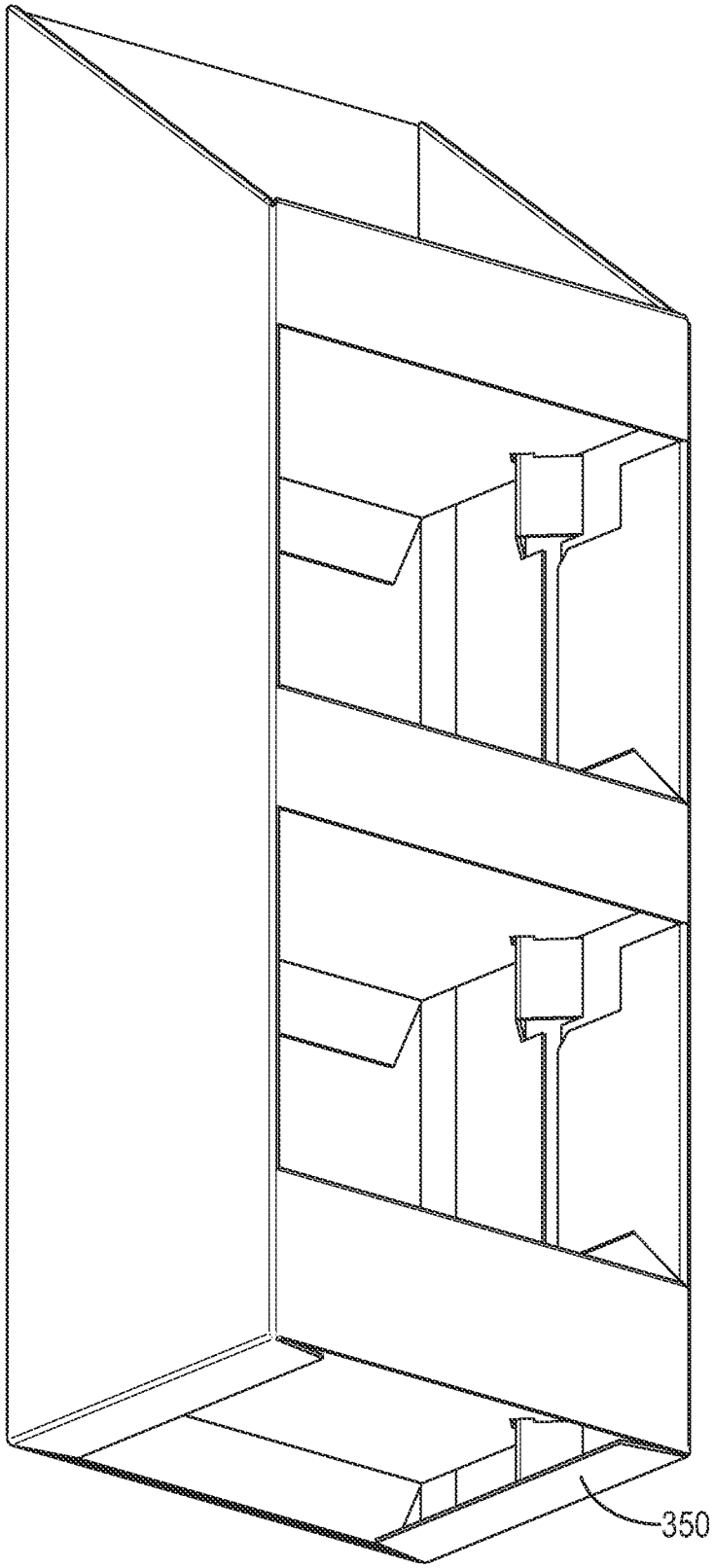
FIG. 2 is another perspective view thereof.
Figure 3:
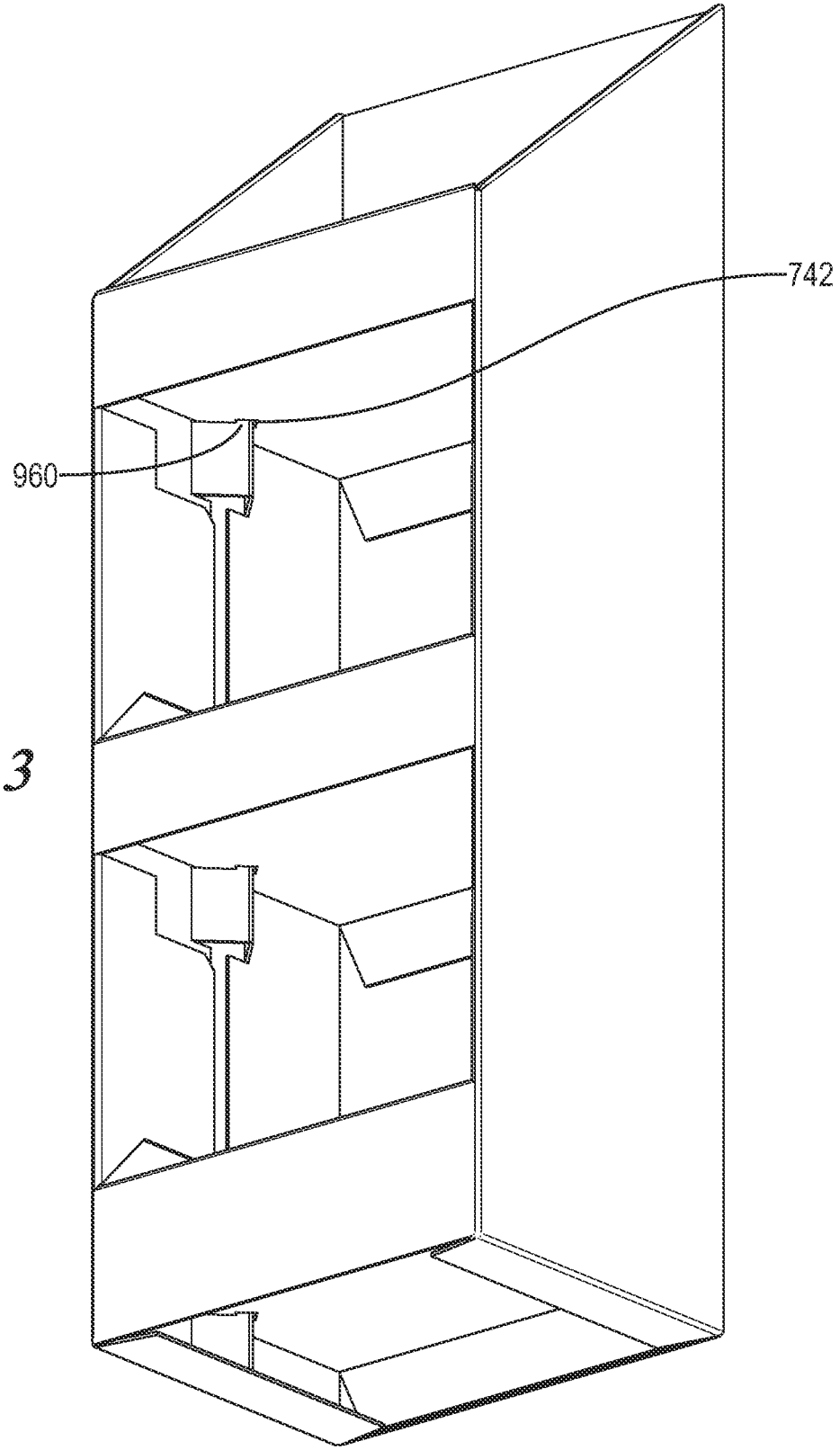
FIG. 3 is another perspective view thereof.
Figure 4:
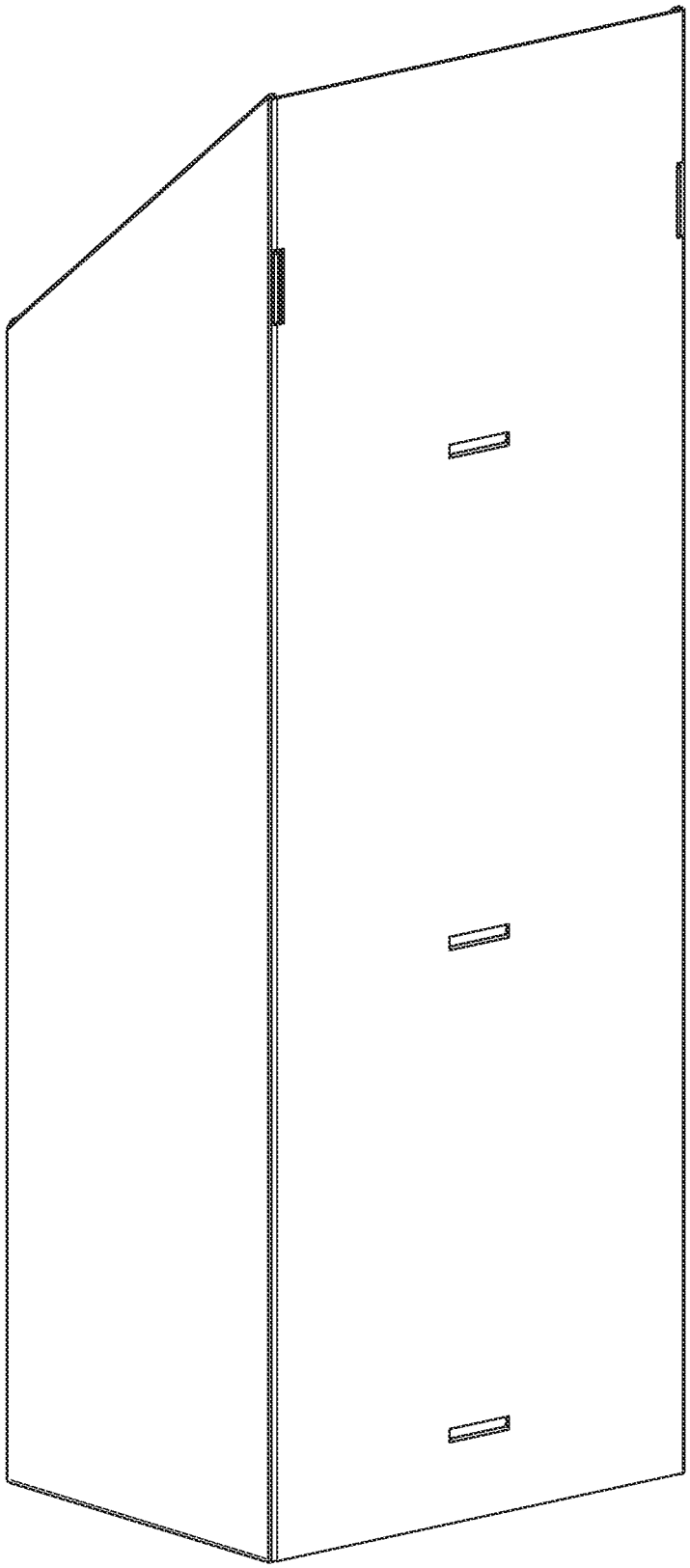
FIG. 4 is another perspective view thereof.
Figure 5:
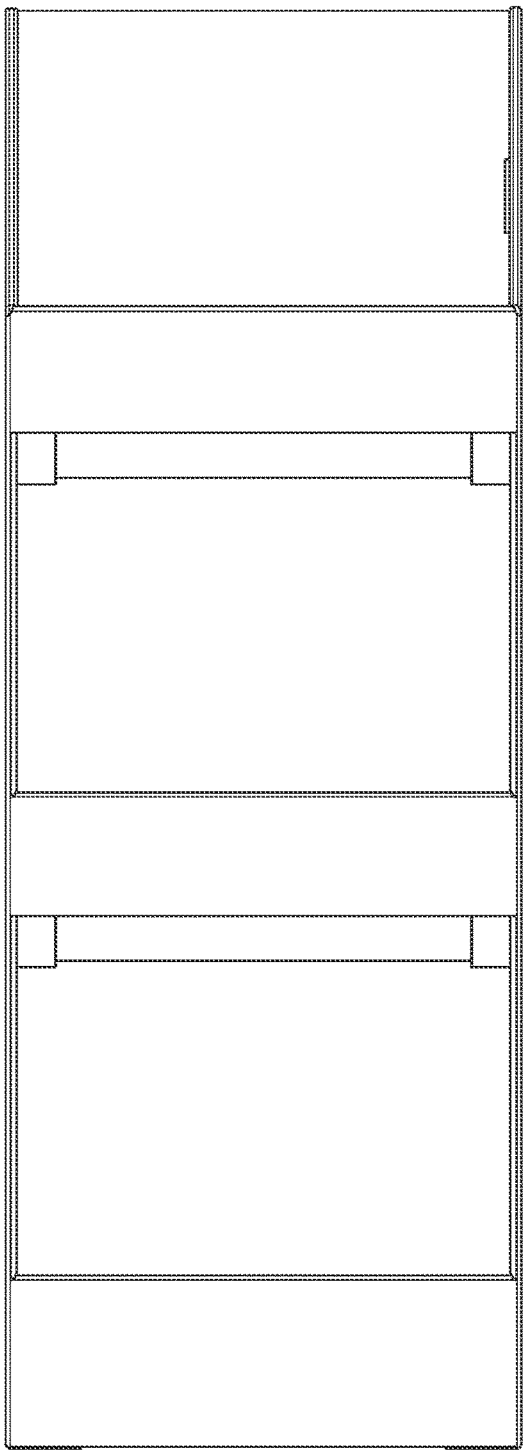
FIG. 5 is a front view thereof.
Figure 6:
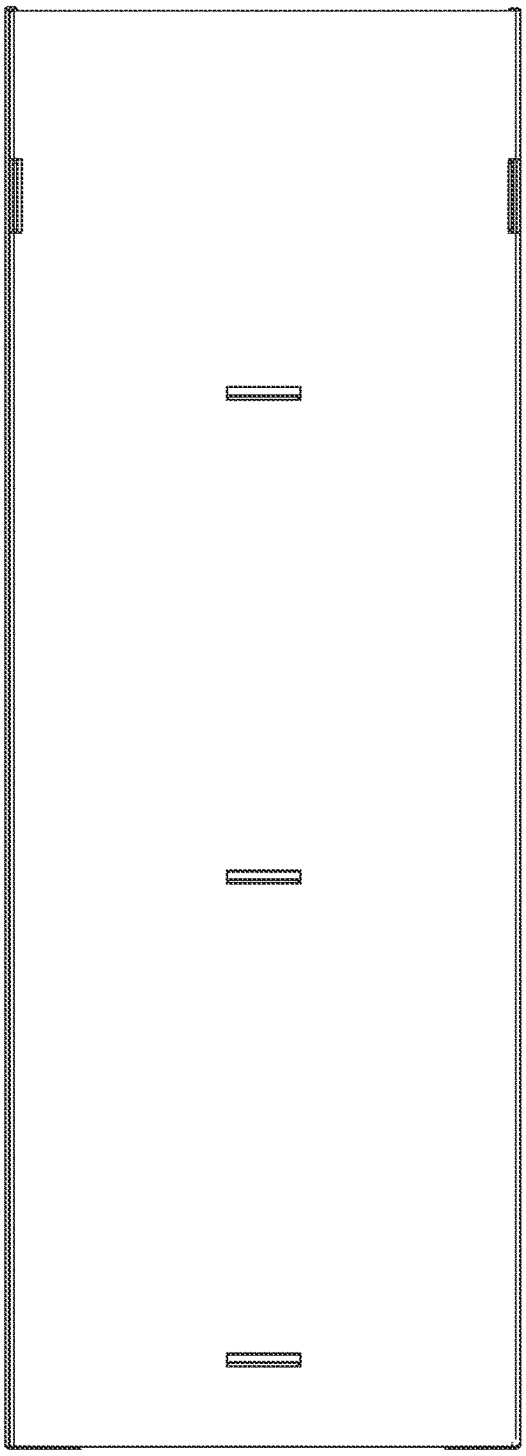
FIG. 6 is a back view thereof.
Figure 7:
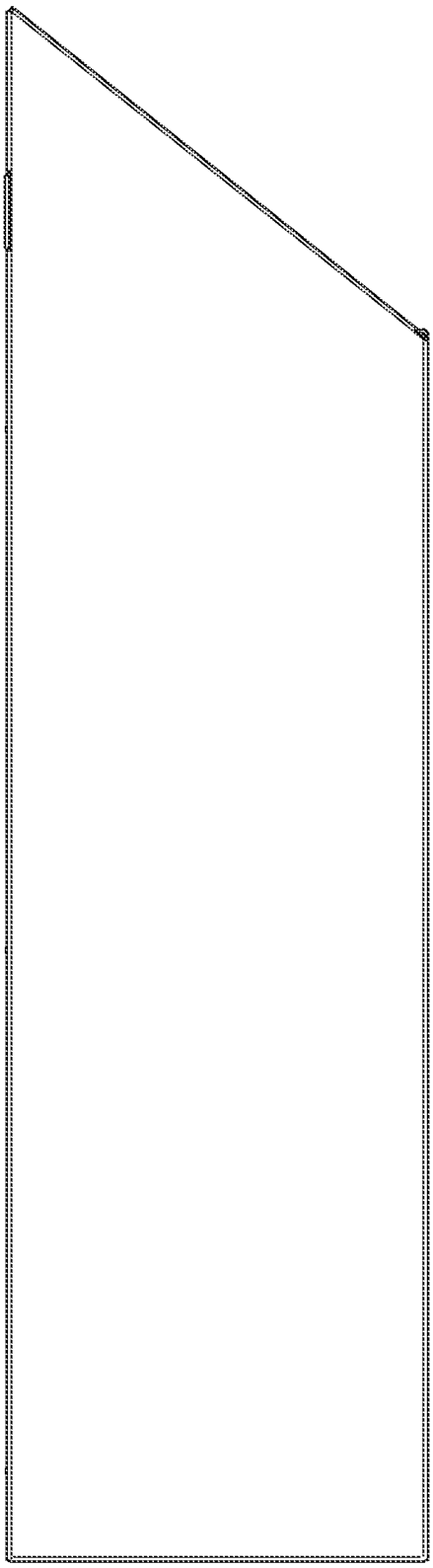
FIG. 7 is a left side view thereof.
Figure 8:
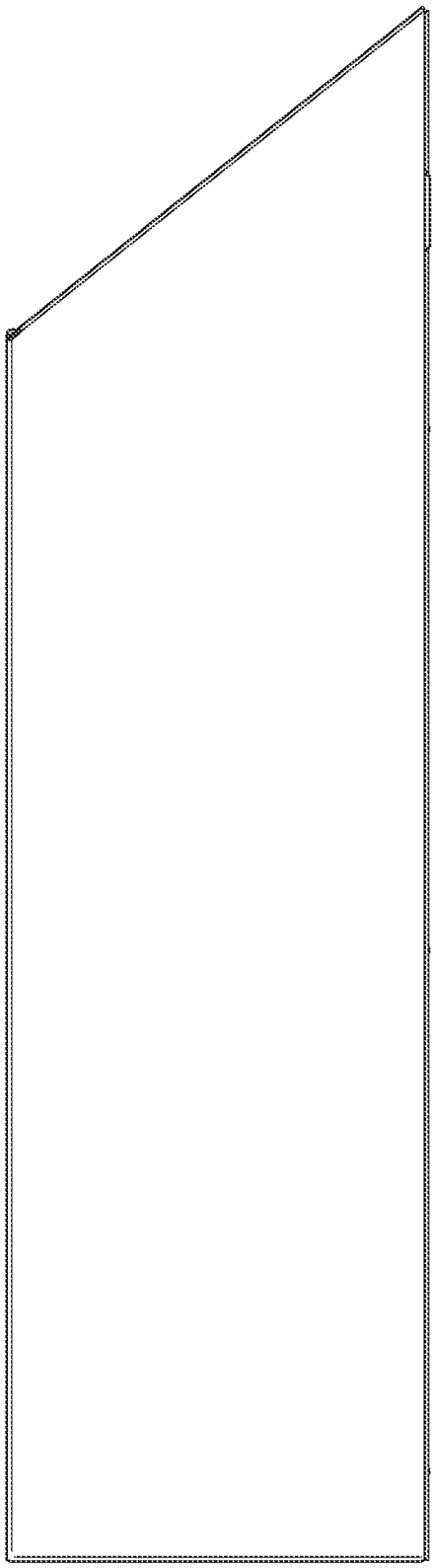
FIG. 8 is a right side view thereof.
Figure 9:
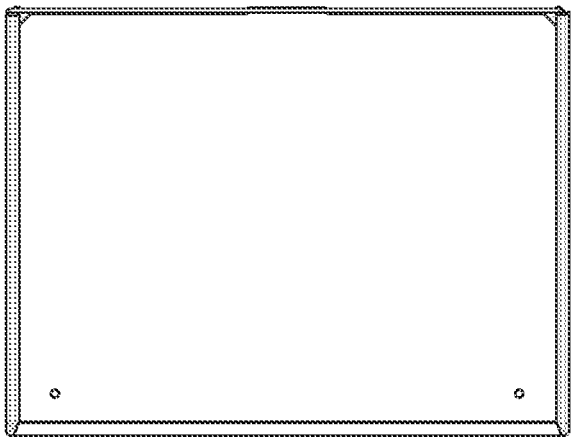
FIG. 9 is a top view thereof.
Figure 10:
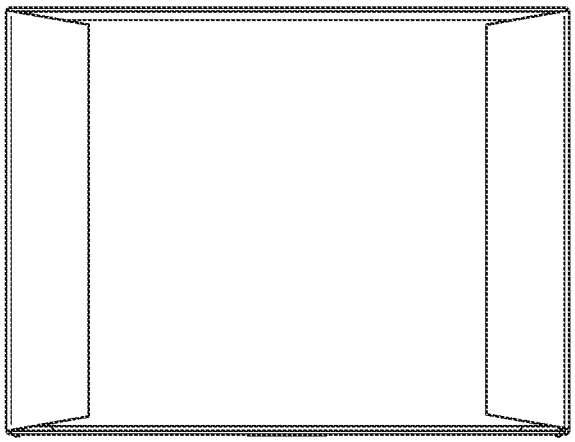
FIG. 10 is a bottom view thereof.
Figure 11:
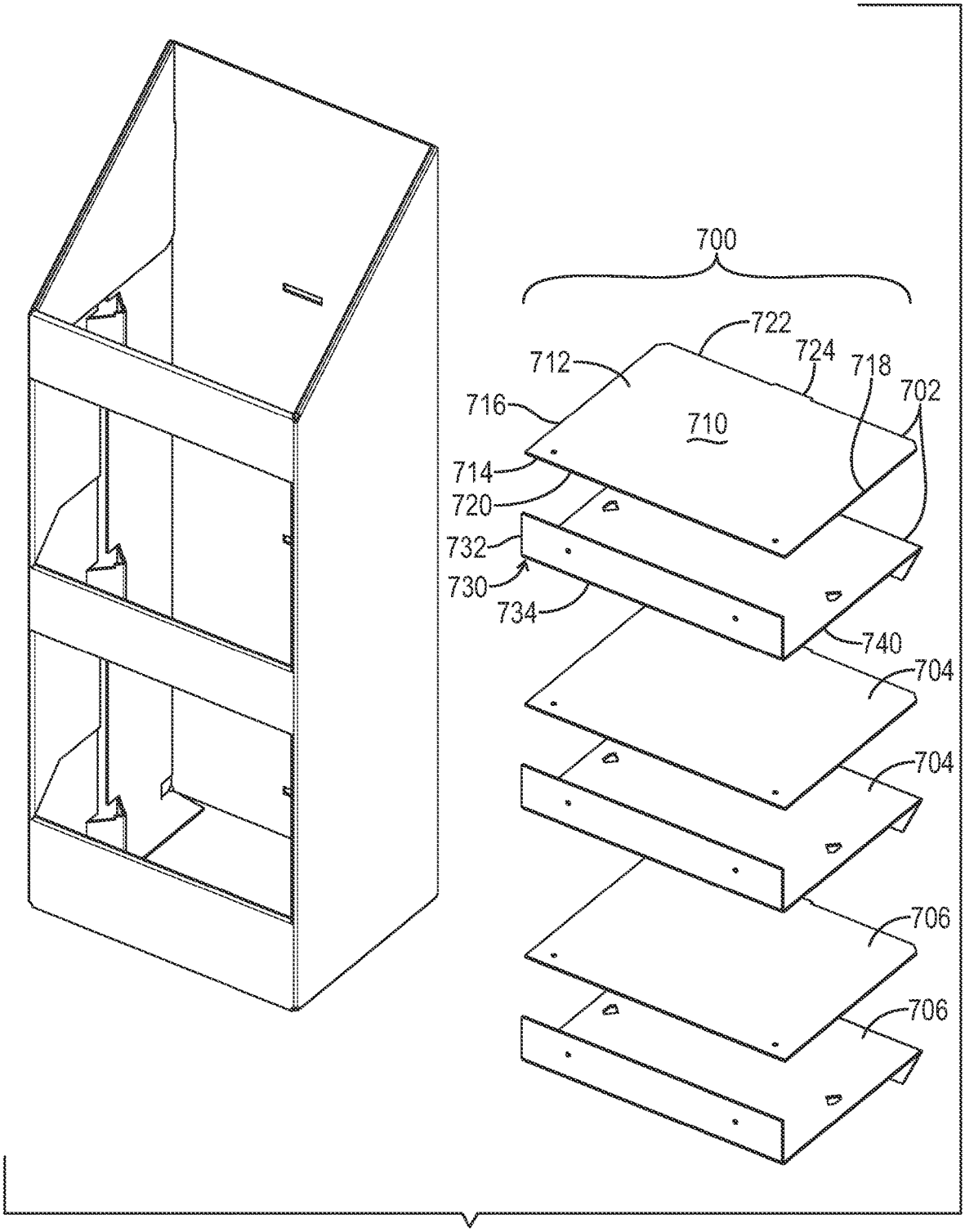
FIG. 11 shows an exploded view of the shelves showing the upper place and the lower frame.
Figure 12:
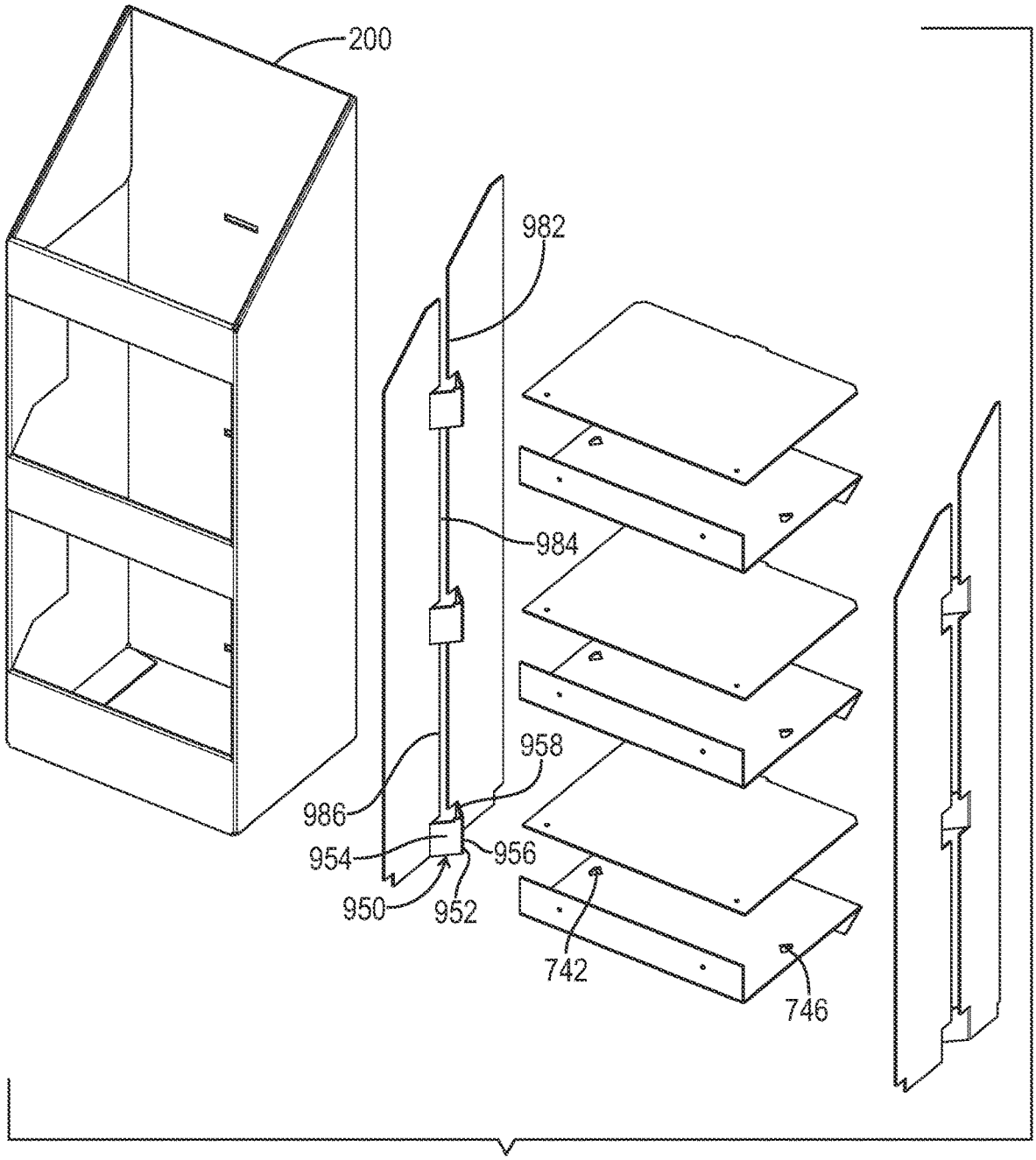
FIG. 12 shows a further exploded view of the support body with the brace arms.
Figure 13:
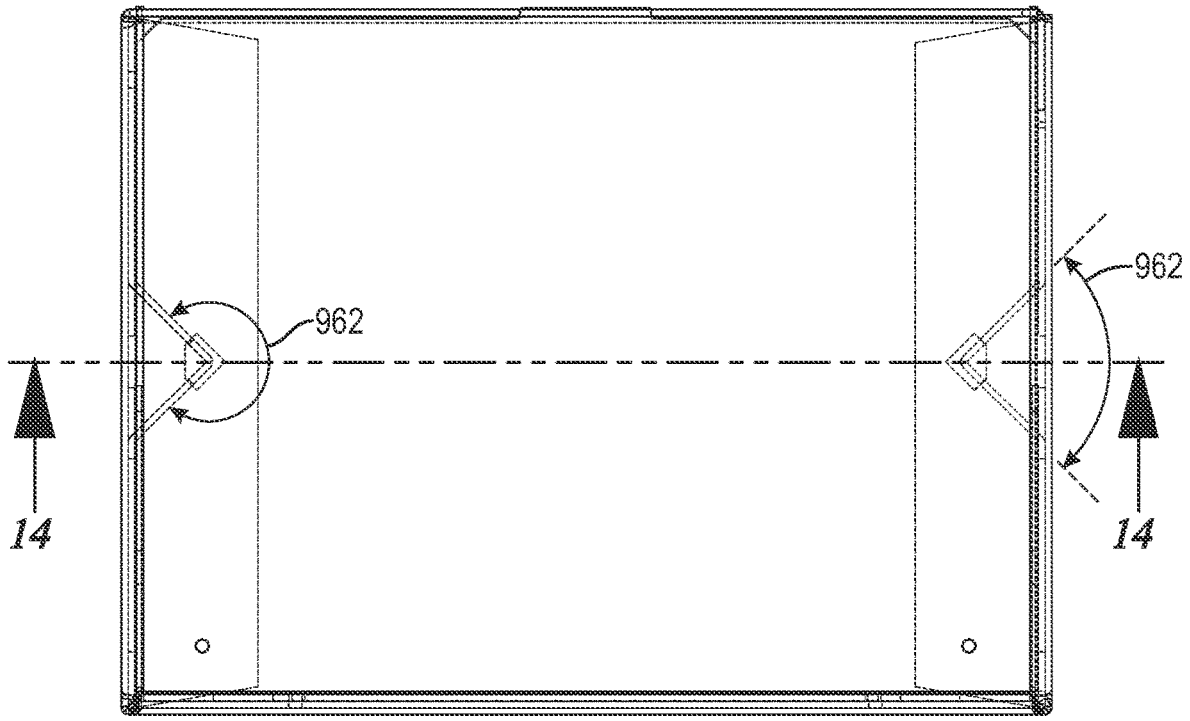
FIG. 13 shows a bottom with of the brace arms against a shelf lower frame.
Figure 14:
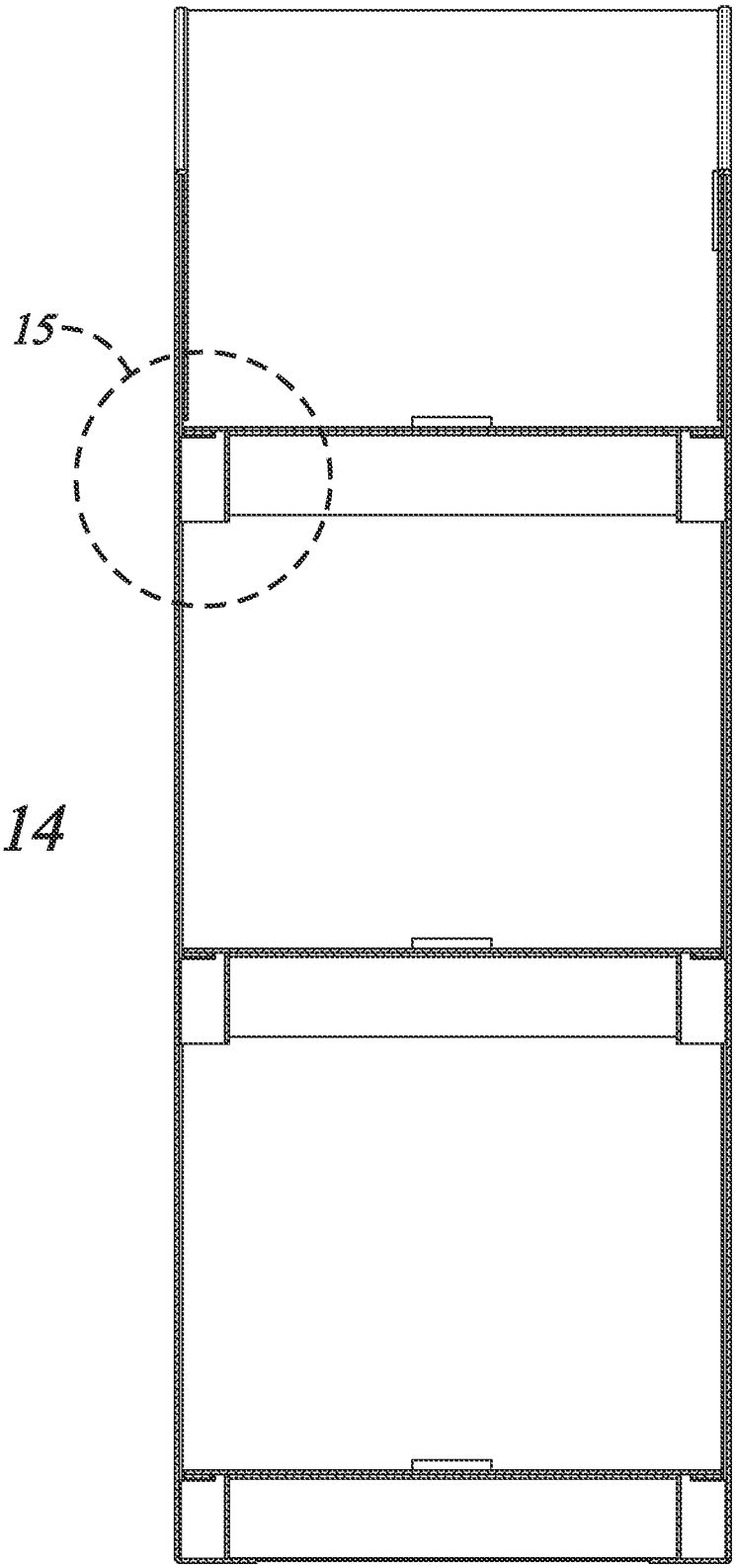
FIG. 14 shows a cutaway view along the line 14-14 of FIG. 13.
Figure 15:
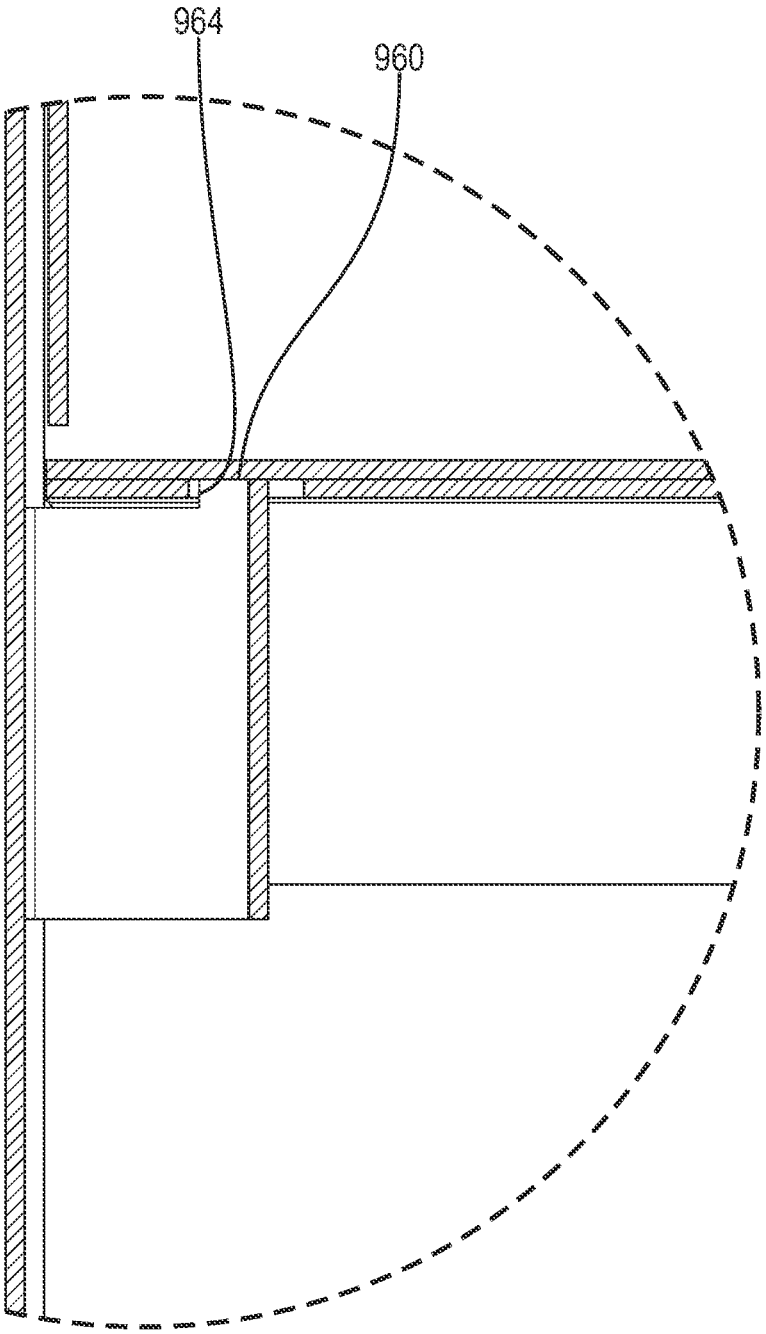
FIG. 15 shows an enlarged view of the section indicated in FIG. 14.
Figure 16:
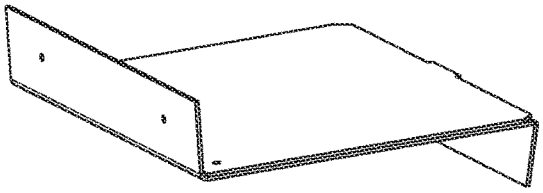
FIG. 16 shows the shelf lower frame in the unfolded support position.
Figure 17:
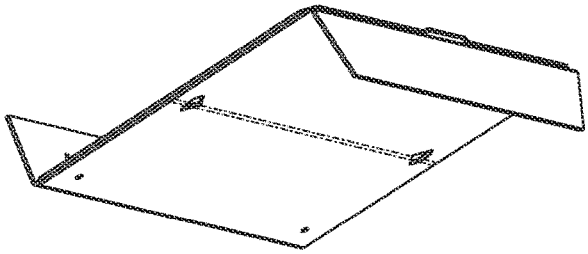
FIG. 17 shows another perspective view thereof.
Figure 18:
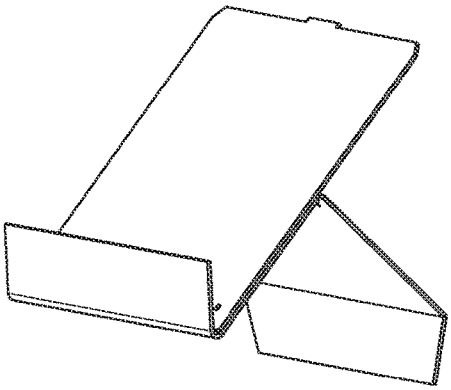
FIG. 18 shows the shelf lower frame in a partially folded/unfolded position.
Figure 19:
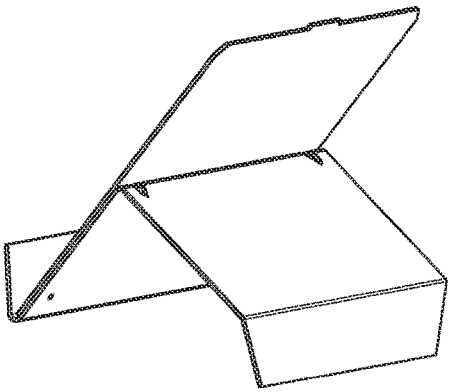
FIG. 19 shows another perspective view thereof.
Figure 20:
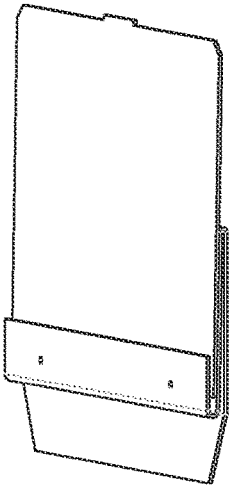
FIG. 20 shows the shelf lower frame in the folded transport position.
Figure 21:
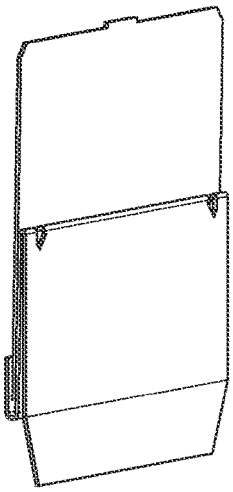
FIG. 21 shows another perspective view thereof.
Figure 22:
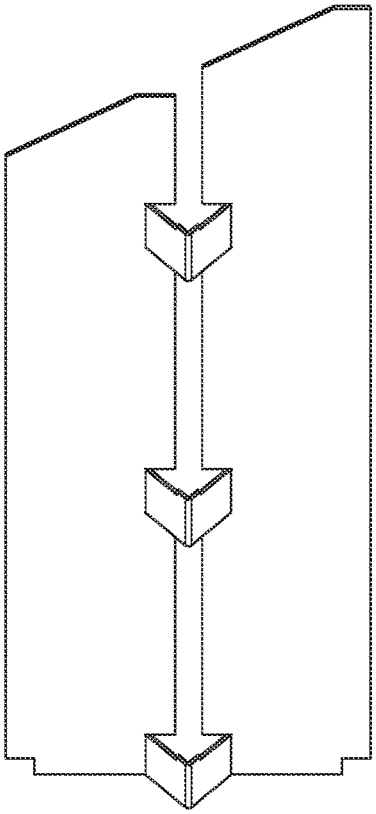
FIG. 22 shows the support body in the unfolded support position.
Figure 23:
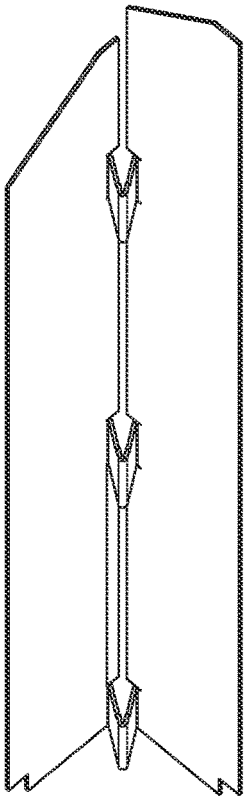
FIG. 23 shows the support body partially folded.
Figure 24:
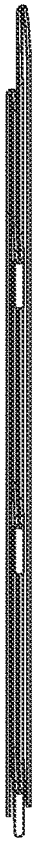
FIG. 24 shows the support body in the folded position.
Figure 25:
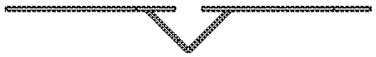
FIG. 25 shows a top view of the support body in the unfolded support position.
Figure 26:
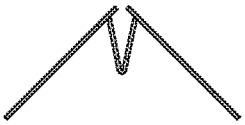
FIG. 26 shows a top view of the support body partially folded.
Figure 27:
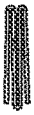
FIG. 27 shows a top view of the support body in the folded position.
Figure 28:
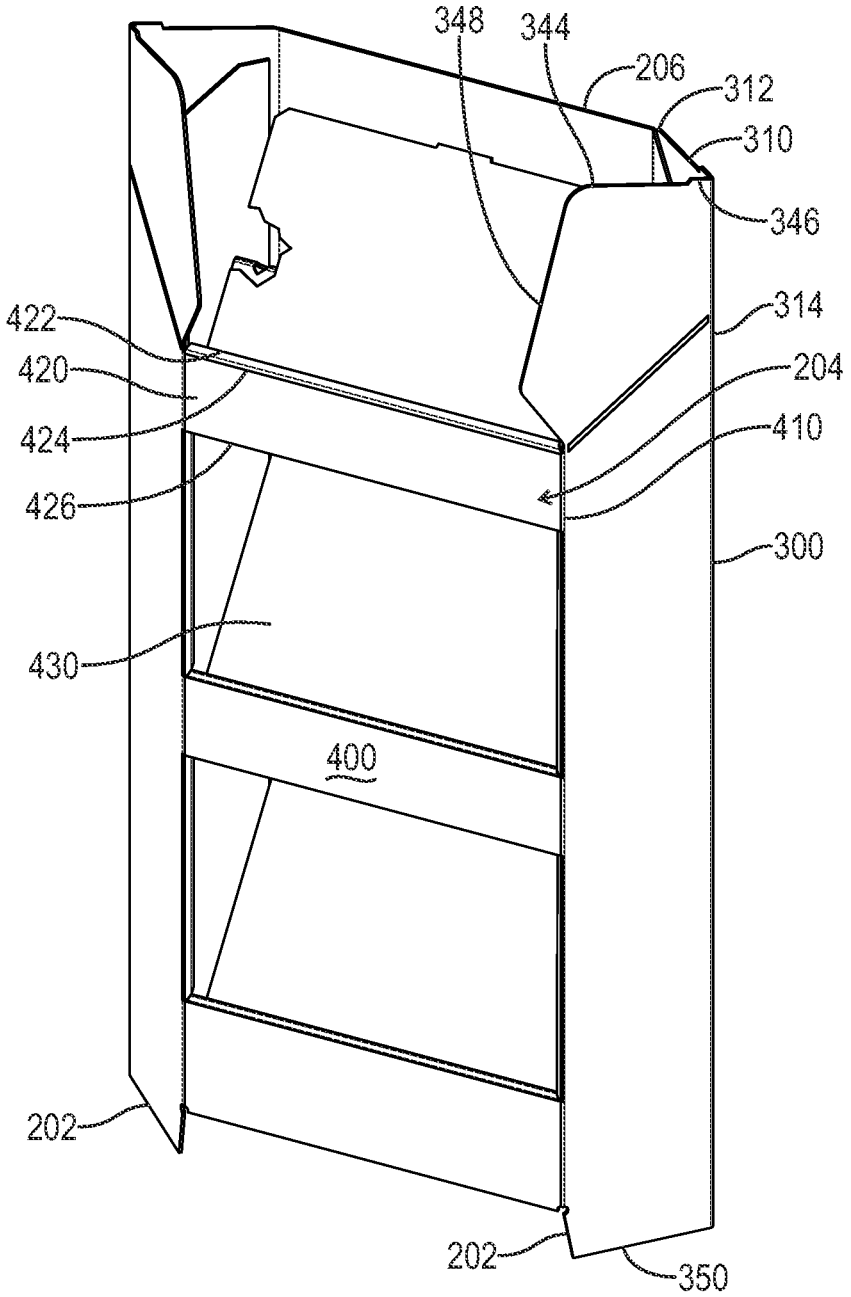
FIG. 28 shows the display apparatus in a partially folded position with a cutaway of the top shelf showing the folding of the shelf frame.
Figure 29:
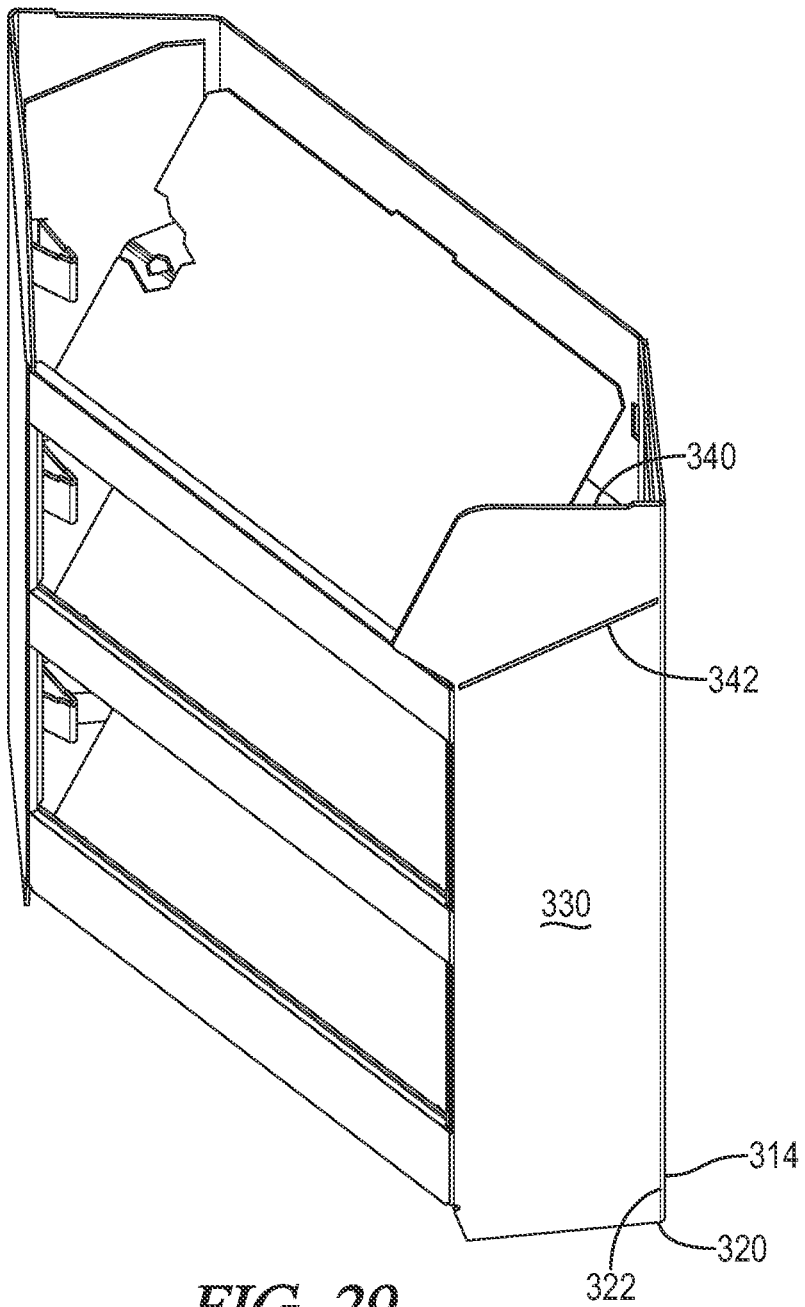
FIG. 29 is another perspective view thereof rotated to the see the partially folded head brace arm.
Figure 30:
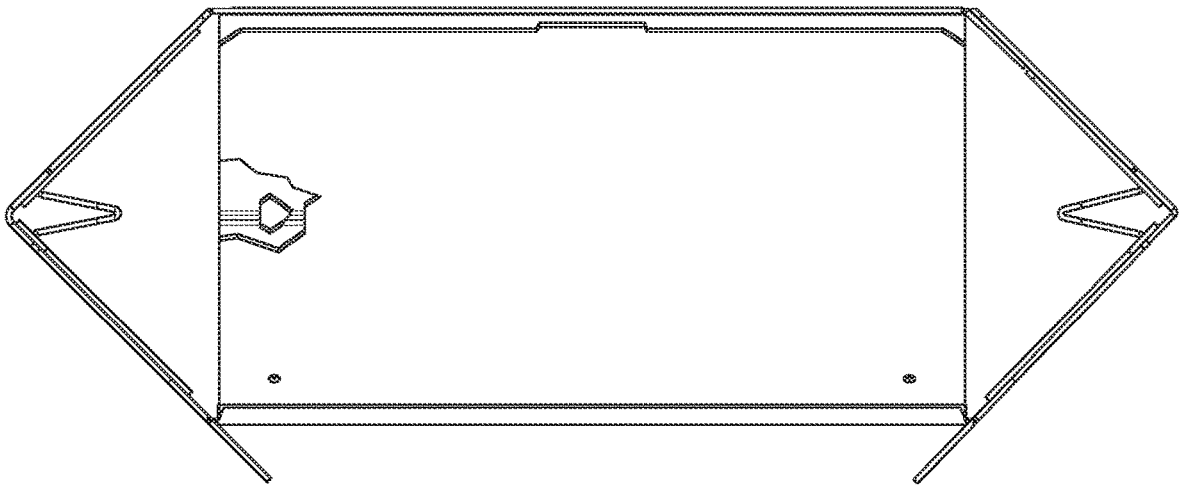
FIG. 30 is a top view thereof.
Figure 31:
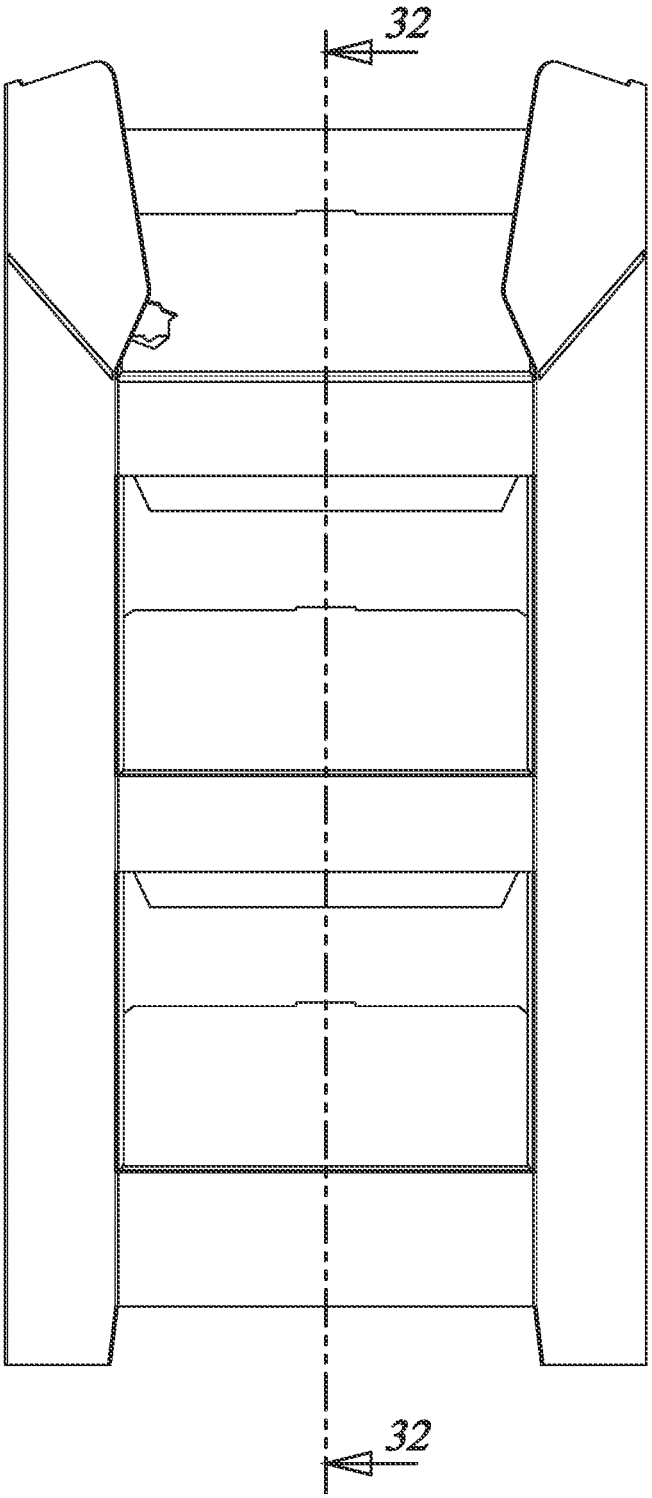
FIG. 31 is a front view thereof.
Figure 32:
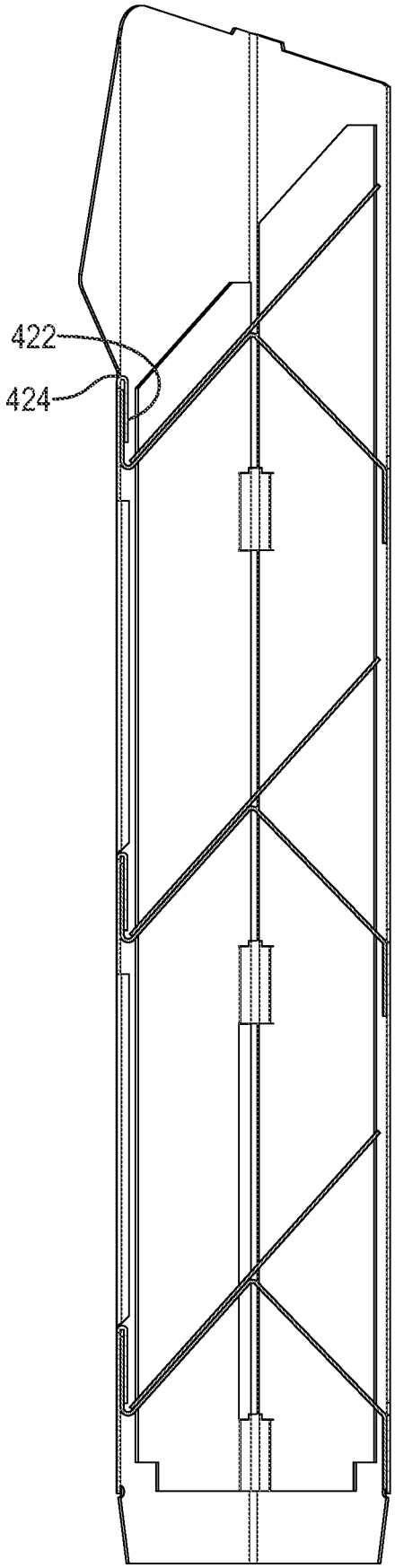
FIG. 32 is a cutaway view along the line of 32-32 in FIG. 31.
Figure 33:
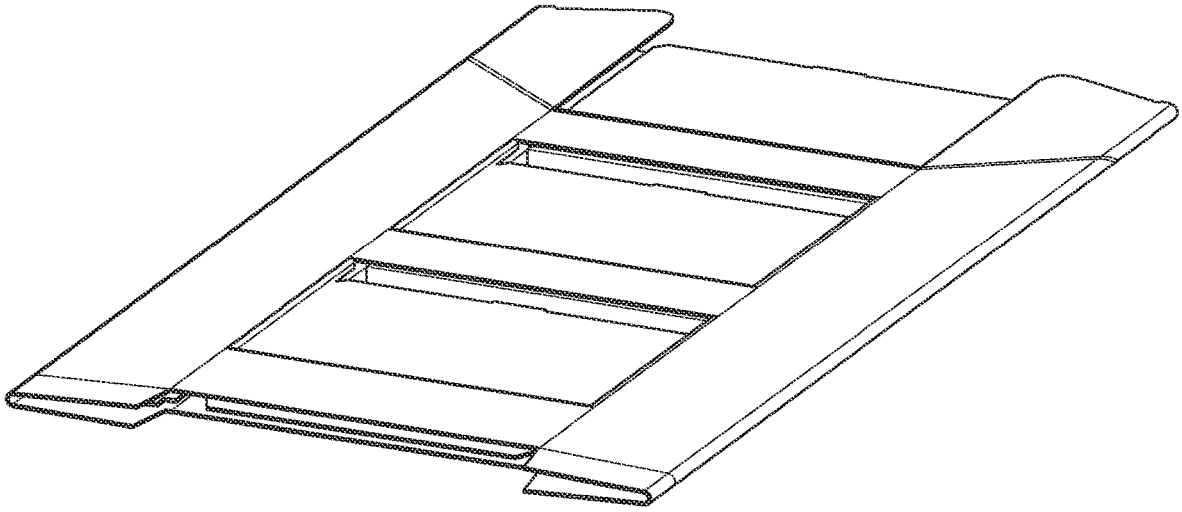
FIG. 33 is a perspective view of the display apparatus in a folded position.
Figure 34:
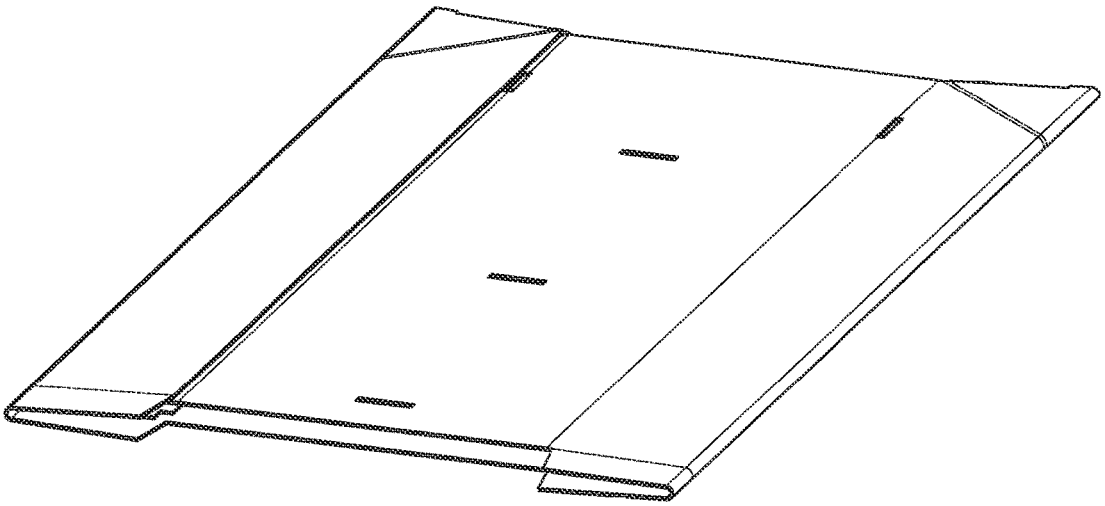
FIG. 34 is another perspective view thereof.
Figure 35:
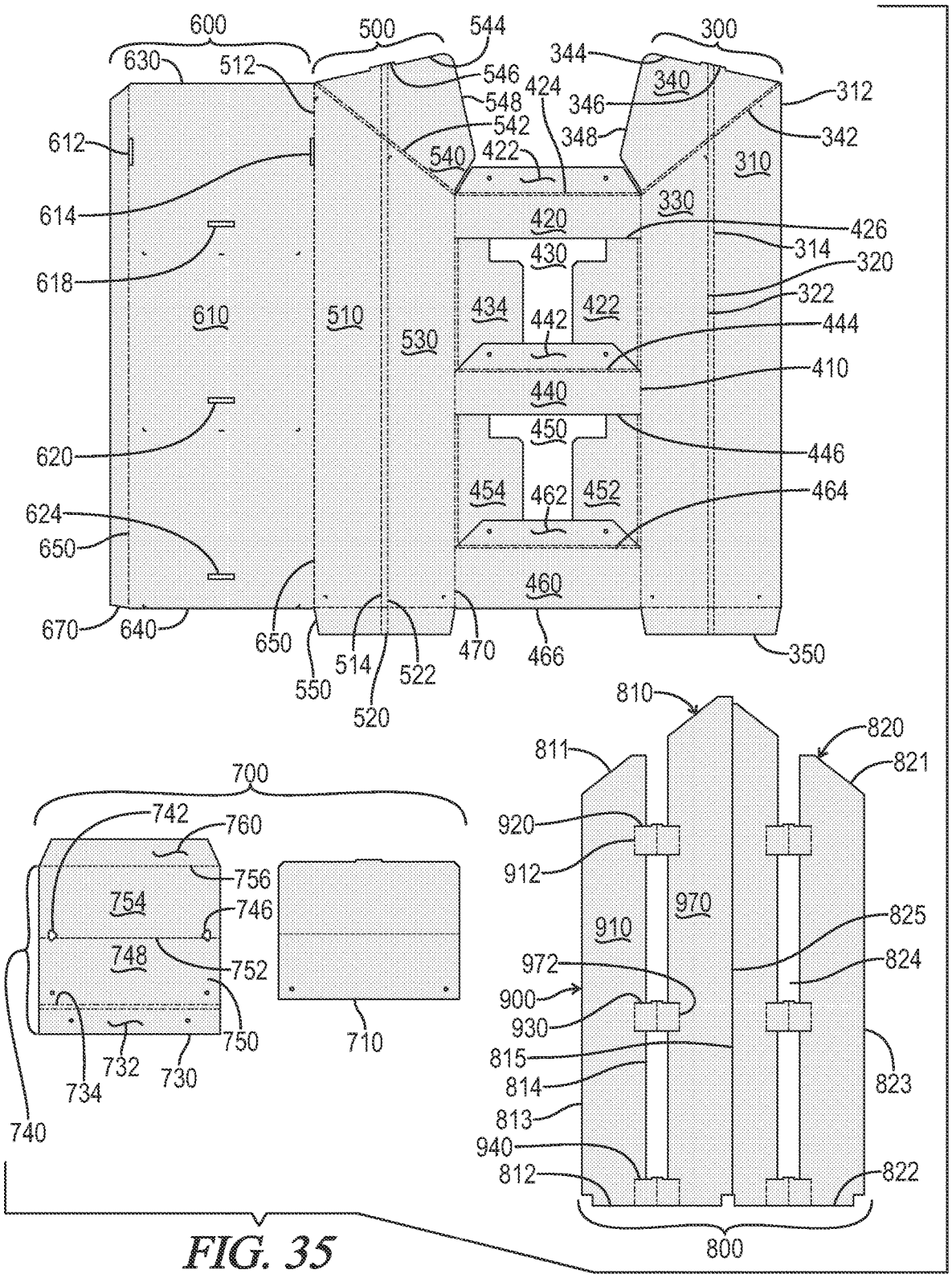
FIG. 35 is the cutouts for the components with fold lines indicated as broken lines.

As shown in FIGS. 1 through 35 of the drawings, one exemplary embodiment of the present invention is generally shown as a folding angle shelf support display apparatus 100. The folding angle shelf support display apparatus 100 has a display top 110, display bottom 120, display left side 130, display right side 140, display front 150, and display back 160. The folding angle shelf support display apparatus 100 is made up of an outer frame 200, inner support 800, and shelves 700.

The outer frame 200 is made with opposing side positioned outward folding walls 202 connecting a forward facing beam aperture wall 204 to a rear panel wall 206. The forward facing beam aperture wall includes the front wall 400. The opposing side positioned outward folding walls 202 includes the outward folding right side wall 300 and the outward folding left side wall 500. The rear panel wall 206 includes the back wall 600.

Starting at the back right corner we can see the outward folding right side wall 300 with its right back panel 310 connecting a right back edge 312 to a right vertical back crease 314 that connects to a right edge panel 320 to a right vertical front crease 322 and then connects to a right front panel 330. The outward folding right side wall 300 includes an upper right inward folding reinforcement flap 340 with a top right angle crease 342, a right top fold to back edge 344 with a right back side flap locking tab 346, and a right front fold to bottom edge 348. The outward folding right side wall 300 also includes a bottom right inward folding foot 350. The outward folding right side wall ends at the front right corner crease 310.

Continuing around, the front wall 400 extends from the front right corner crease 410 across the head shelf cross beam 420 leaving a top aperture 321. The head shelf cross beam 420 includes an inward folding reinforcing head tab 422 connected by a head beam crease 424 and extends down to the head beam bottom edge 426 which defines the top of the mid aperture 430 where the inward folding right mid tab 432 and inward folding left mid tab 434 are located. The front wall also includes a mid shelf cross beam 440 with a inward folding mid tab 442 connected by a mid beam crease 444 and extends down to a mid beam bottom edge 446 that defines the top of the base aperture 450. The base aperture 450 is defined by the inward folds of the inward folding right base tab 452 and inward folding left base tab 454. The front wall still further includes the base shelf cross beam 460 with inward folding base tab 462, base beam crease 464, base and beam bottom edge 466. The front wall ends at the front left corner crease 470 where it joins to the outward folding left side wall 500.

The outward folding left side wall 500 includes a left back panel 510, left back edge 512, left vertical back crease 514, left edge panel 520, left vertical front crease 522, left front panel 530, upper left inward folding reinforcement flap 540, top left angle crease 542, left top fold to back edge 544, left back side flap locking tab 546, left front fold to bottom edge 548, and bottom left inward folding foot 550 that work similar to the opposing right side wall 300.

The back wall 600 includes a stiffening back panel 610 defining the right side locking aperture 612, left side locking aperture 614, head shelf locking aperture 618, mid shelf locking aperture 620, and base shelf locking aperture 624. The stiffening back panel 610 extends from the back top edge 630 to the back bottom edge 640, and from the back left corner crease 650 to the back right corner crease 660 that is connected to a wall connection flap 670 that is connected to the inside of the outward folding right side wall 300. In this manner, a standing rectangle has been formed with supporting beams defining apertures for product display.

The shelves 700 are hingably connected to the front wall 400 and the back wall 600 and supported by the outward folding right side wall 300 outward folding left side wall 500. The shelves 700 include the head shelf 702, mid shelf 704, and base shelf 706.

Each shelf 702, 704, 706 includes a shelf upper plate 710, and a lower frame 730. The shelf upper plate 710 includes a plate top surface 712, a plate bottom surface 714, a left edge 716, right edge 718, front edge 720, and back edge 722 with a shelf locking tab 724. Connected to the plate bottom surface 714 is the lower frame 730. The lower frame 730 includes a front flap 732 that is connected to the front wall 400 and the front hinge 734. The front hinge 734 is connected to the folding plate 740. The folding plate 740 defines the left angle shaped support locking aperture 742 and the right angle shaped support locking aperture 746. The folding plate 740 includes the front plate 748 with a front upper surface 750 connected to the plate bottom 714. The front plate 748 is also connected to the upward folding crease 752 to the back plate 754 that is hingably connected by the back hinge 756 to the back flap 760. The back flap is connected to the back wall 600. In this manner, the front wall 400 and back wall 600 can move together while each shelf 702, 704, 706 pivot upward for compression, and pivot downward when unfolded.

The inner support 800 stiffens the side walls of the structure, aligns the folding of the structure, and provides unique shelf support. The inner support 800 includes a shelf left side support 810 with a left support top edge 811 and left support bottom edge 812 and extends from the left support front edge 813 across the left support gap 814 to the left support back edge 815. The shelf right side support 820 extends from the right support top edge 821 to the right support bottom edge 822 and the right support front edge 823 across the right support gap 824 to the right support back edge 825.

Each of the shelf left side support 810 and the shelf right side support 820 includes a support body 900. Each support body 900 includes a front stiffening plate 910 connected by a front support hinge 912 to a head brace arm 920, mid brace arm 930, and base brace arm 940 to the back stiffening plate 970 by the back support hinge 972. In this manner they form an inward folding extending body 950 that has a triangular body 952 with the front extending arm 954, inner arm hinge 956, and back extending arm 958 combined with the gaps 980 to form the triangular shape. At the inner arm hinge ends of the arms 954, 958 that is a support locking tab 960 that is formed at a locking angle 962 and includes a locking edge 964 that locks the sides in the unfolded position. The plate gaps 980 include the head gap 982, mid gap 984, and base gap 986.

Reference numerals used throughout the detailed description and the drawings correspond to the following elements:

folding angle shelf support display apparatus 100 top 110
bottom 120
left side 130
right side 140
front 150
back 160
outer frame 200
  opposing outward folding walls 202
  beam aperture wall 204
  panel wall 206
outward folding right side wall 300
  right back panel 310
    right back edge 312
    right vertical back crease 314
  right edge panel 320
    right vertical front crease 322
  right front panel 330
  upper right inward folding reinforcement flap 340
    top right angle crease 342
    right top fold to back edge 344
      right back side flap locking tab 346
    right front fold to bottom edge 348
  bottom right inward folding foot 350
  front wall 400
    front right corner crease 410
      head shelf cross beam 420
        inward folding reinforcing head tab 422
        head beam crease 424
        head beam bottom edge 426
      mid aperture 430
        inward folding right mid tab 432
        inward folding left mid tab 434
      mid shelf cross beam 440
        inward folding mid tab 442
        mid beam crease 444
        mid beam bottom edge 446
      base aperture 450
        inward folding right base tab 452
        inward folding left base tab 454
      base shelf cross beam 460
        inward folding base tab 462
        base beam crease 464
        base beam bottom edge 466
      front left corner crease 470
outward folding left side wall 500
  left back panel 510
    left back edge 512
    left vertical back crease 514
  left edge panel 520
    left vertical front crease 522
  left front panel 530
  upper left inward folding reinforcement flap 540
    top left angle crease 542
    left top fold to back edge 544
      left back side flap locking tab 546
    left front fold to bottom edge 548
  bottom left inward folding foot 550
back wall 600
  back panel 610
    right side locking aperture 612
    left side locking aperture 614
    head shelf locking aperture 618
    mid shelf locking aperture 620
    base shelf locking aperture 624
  back top edge 630
  back bottom edge 640
  back left corner crease 650
  back right corner crease 660
  wall connection flap 670
shelves 700
  head shelf 702
  mid shelf 704
  base shelf 706
  shelf upper plate 710
    plate top surface 712
    plate bottom surface 714
      left edge 716
      right edge 718
      front edge 720
      back edge 722
      shelf locking tab 724
  lower frame 730
    front flap 732
      front hinge 734
    folding plate 740
      left angle shaped support locking aperture 742
      right angle shaped support locking aperture 746
    front plate 748
      front upper surface 750
      upward folding crease 752
    back plate 754
      back hinge 756
    back flap 760
inner support 800
  shelf left side support 810
    left support top edge 811
    left support bottom edge 812
    left support front edge 813
    left support gap 814
    left support back edge 815
  shelf right side support 820
    right support top edge 821
    right support bottom edge 822
    right support front edge 823
    right support gap 824
    right support back edge 825
  support body 900
    front stiffening plate 910
    front support hinge 912
    head brace arm 920
    mid brace arm 930
    base brace arm 940
    inward folding extending body 950
      triangular body 952
        front extending arm 954
        inner arm hinge 956
        back extending arm 958
    support locking tab 960
      locking angle 962
      locking edge 964
    back stiffening plate 970
      back support hinge 972
    plate gaps 980
      head gap 982
      mid gap 984
      base gap 986

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, any method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

The invention claimed is:

1. A folding angle shelf support display apparatus, comprising:

a back panel connected to a front opposing beam by a side outward folding wall including a vertical fold crease;

a shelf connected to the back panel and the front opposing beam;

the shelf supported by an inward folding inner support connected to the side outward folding wall, the inner support including at least one gap adjacent the vertical fold crease;

the side outward folding wall including an inward folding reinforcement flap;

the back panel defining a side locking aperture; and the inward folding reinforcement flap including a flap locking tab positioned to engage the side locking aperture.

2. A folding angle shelf support display apparatus, comprising:

a back panel connected to a front opposing beam by p side outward folding wall including a vertical fold crease;

a shelf connected to the back panel and the front opposing beam;

the shelf supported by an inward folding inner support connected to the side outward folding wall, the inner support including at least one gap adjacent the vertical fold crease;

the side outward folding wall including an inward folding reinforcement flap;

the inward folding inner support including a stiffener plate; and the stiffener plate including two plates separated by a gap.

3. A folding angle shelf support display apparatus, comprising:

a back panel connected to a front opposing beam by a side outward folding wall including a vertical fold crease;

a shelf connected to the back panel and the front opposing beam, the shelf defining a support locking aperture;

the shelf supported by an inward folding inner support connected to the side outward folding wall, the inner support including at least one gap adjacent the vertical fold crease;

the side outward folding wall including an inward folding reinforcement flap;

the inward folding inner support including an inward folding extending body;

the inward folding extending body including a front extending arm connected to an inner arm hinge connected to a back extending arm; and the inner arm hinge including a support locking tab positioned to engage the support locking aperture.

* * * * *